US008186089B2

(12) United States Patent
Werner et al.

(10) Patent No.: US 8,186,089 B2
(45) Date of Patent: May 29, 2012

(54) GRIP ENHANCER ASSEMBLY FOR HANDGUNS

(75) Inventors: Martin Werner, Elchingen (DE); Wulf-Heinz Pflaumer, Arnsberg (DE); Franz Wonisch, Arnsberg (DE)

(73) Assignee: Carl Walther GmbH, Ulm (DE)

( * ) Notice: Subject to any disclaimer, the term of this patent is extended or adjusted under 35 U.S.C. 154(b) by 0 days.

(21) Appl. No.: 12/227,000

(22) PCT Filed: Mar. 22, 2007

(86) PCT No.: PCT/DE2007/000523

§ 371 (c)(1), (2), (4) Date: May 24, 2010

(87) PCT Pub. No.: WO2007/128252

PCT Pub. Date: Nov. 15, 2007

(65) Prior Publication Data

US 2010/0132238 A1 Jun. 3, 2010

(30) Foreign Application Priority Data

May 4, 2006 (DE) ..... 10 2006 020 732

(51) Int. Cl.
*F41C 23/10* (2006.01)

(52) U.S. Cl. ..... 42/71.02; 42/7

(58) Field of Classification Search ..... 42/7, 71.01, 42/71.02, 72, 73, 74
See application file for complete search history.

(56) References Cited

U.S. PATENT DOCUMENTS

| | | | | | |
|---|---|---|---|---|---|
| 1,015,490 | A | * | 1/1912 | Harrington | 42/7 |
| 3,683,535 | A | * | 8/1972 | Lewis | 42/71.02 |
| 4,286,401 | A | * | 9/1981 | Pachmayr et al. | 42/71.02 |
| 4,586,282 | A | * | 5/1986 | Sniezak | 42/71.02 |
| 4,936,036 | A | * | 6/1990 | Sniezak et al. | 42/71.02 |
| 4,998,367 | A | * | 3/1991 | Leibowitz | 42/71.02 |
| 5,231,237 | A | * | 7/1993 | Cupp | 42/71.02 |
| 5,465,520 | A | * | 11/1995 | Cupp | 42/71.02 |
| 5,483,766 | A | * | 1/1996 | Hochstrate et al. | 42/75.03 |
| 5,621,997 | A | * | 4/1997 | Pearce | 42/71.02 |
| 6,028,765 | A | * | 2/2000 | Swindler et al. | 361/679.55 |

(Continued)

FOREIGN PATENT DOCUMENTS

DE 30 00 017 11/1980

(Continued)

OTHER PUBLICATIONS

International Search Report, Date: Sep. 11, 2007.

*Primary Examiner* — Michael Carone
*Assistant Examiner* — Joshua Freeman
(74) *Attorney, Agent, or Firm* — Collard & Roe, P.C.

(57) ABSTRACT

An exchangeable adapter assembly for a handgun includes a handle frame having a trigger and a handle, into which a magazine can be inserted. A quick changeover is ensured by the assembly in that in the rear and front regions of the handle frame at least one adapter element is provided which cooperates with a rear and front adapter piece of a grip enhancer for attachment of the grip enhancer 100 to the handle frame. In the rear part of the handle frame there is also provided an eyelet device which, when the grip enhancer is attached to the handle frame, positively engages a bore in the grip enhancer. A securing pin can be releasably inserted into the eyelet device in order to releasably connect the grip enhancer to the handle frame.

10 Claims, 7 Drawing Sheets

U.S. PATENT DOCUMENTS

| | | | | |
|---|---|---|---|---|
| 6,073,381 | A * | 6/2000 | Farrar et al. | 42/71.02 |
| 6,112,446 | A * | 9/2000 | Forster et al. | 42/71.02 |
| 6,928,764 | B2 * | 8/2005 | Freed | 42/71.02 |
| 7,155,855 | B2 * | 1/2007 | Mauch et al. | 42/70.01 |
| 7,191,556 | B2 * | 3/2007 | Pikielny | 42/7 |
| 7,506,469 | B2 * | 3/2009 | Poulin et al. | 42/71.02 |
| 7,562,480 | B2 * | 7/2009 | Mauch et al. | 42/70.01 |
| 7,765,999 | B1 * | 8/2010 | Stephens et al. | 124/73 |
| 2005/0278897 | A1 * | 12/2005 | Tillim | 16/430 |
| 2006/0162222 | A1 * | 7/2006 | Beretta | 42/72 |
| 2008/0060247 | A1 * | 3/2008 | Thomele et al. | 42/71.02 |
| 2010/0132238 | A1 * | 6/2010 | Werner et al. | 42/71.02 |
| 2010/0212202 | A1 * | 8/2010 | Roth | 42/71.01 |

FOREIGN PATENT DOCUMENTS

| | | |
|---|---|---|
| DE | 195 05 829 | 8/1996 |
| EP | 0 866 303 | 9/1998 |
| EP | 1 460 369 | 9/2004 |

* cited by examiner

GRIP ENHANCER ASSEMBLY FOR HANDGUNS

CROSS REFERENCE TO RELATED APPLICATIONS

This application is the National Stage of PCT/DE2007/000523 filed on Mar. 22, 2007, which claims priority under 35 U.S.C. §119 of German Application No. 10 2006 020 732.7 filed on May 4, 2006. The international application under PCT article 21(2) was not published in English.

The invention relates to an exchangeable assembly for the handle frame of a handgun comprising a trigger and a handle, into which a magazine including a magazine base can be inserted, the handgun handle frame having a front region close to the handle frame and a rear region more remote from the handle frame.

Devices of the type described above are used in the prior art to render the hand-held handle frame of a handgun adaptable to different dimensions and individual physiognomy. However, the known devices suffer from the drawback that they are difficult to handle and that, in particular, a quick changeover of the exterior dimensions of the handle frame is not possible.

Thus, it is an object of the present invention to provide an exchangeable assembly for a handgun handle frame, which can be quickly exchanged, thereby making it possible to alter the exterior dimensions of the handle frame quickly.

This object is achieved for an assembly as described above in that in the rear and front regions of the handle frame at least one adapter element is provided which cooperates with a rear and front adapter piece of a grip enhancer for attachment of the grip enhancer to the handle frame, and in the rear part of the handle frame there is also provided at least one eyelet device which, when the grip enhancer is attached, positively engages a bore in the grip enhancer, into which a securing pin can be releasably inserted in order to releasably attach the grip enhancer to the handle frame.

Preferred embodiments of the invention are subject matter of the subclaims.

In the assembly of the invention, the combination of features to the effect that in the rear and front regions of the handle frame at least one adapter element is provided which cooperates with a rear and front adapter piece of a grip enhancer for attachment of the grip enhancer to the handle frame, and in the rear part of the handle frame there is also provided at least one eyelet device which, when the grip enhancer is attached, positively engages a bore in the grip enhancer, into which a securing pin can be releasably inserted in order to releasably attach the grip enhancer to the handle frame has the result that the adapter piece of the invention can be securely attached to the handle frame at three points, and that a secure connection to two of these points on the handle frame can be realized by simple cooperation or a snap lock of the relevant adapter elements and adapter pieces, by which means a quick changeover can be accomplished. The securing pin engaging the bore in the grip enhancer, which can be secured in the bore in various suitable ways, ensures the necessary robustness of the connection.

According to a first preferred embodiment of the assembly of the invention, there is provision for the securing pin to be positively inserted into the bore. As an alternative, the securing pin may be provided with, say, a male screw thread adapted to cooperate with a female screw thread in the bore so as to releasably secure the securing pin in the bore.

According to another preferred embodiment of the assembly of the invention, a first adapter piece for the grip enhancer is in the form of a lip which can be placed under the edge of the handle frame, while a corresponding edge of the grip enhancer forms a fulcrum, about which the grip enhancer can be rotated. In particular, the rear adapter piece for the handle frame can be in the form of a lip capable of being positioned under the edge formed by the rear adapter element of the grip enhancer.

According to another preferred embodiment of the assembly of the invention, provision is made for a second adapter element to be in the form of a resilient snap element having a protrusion which can be snapped into the front adapter element of the handle frame, which adapter element is designed as a corresponding recess.

Preferably, the grip enhancer has two side panels, the inner faces of which can be pushed over the corresponding outer faces of the handle frame. The two panels are, for preference, connected to each other by a front connecting member. The inner faces of the panels and the outer faces of the handle frame are preferably, but not necessarily, planar In order to obtain a maximum of possible variations of the handle frame when changing the grip enhancer, the panels vary in length in different grip enhancers and can be adjusted to suit large and small sizes of the palm of the hand by variations in the thickness of the adapter. In particular, the panels for different grip enhancers can be vary in thickness and width, so that the overall exterior dimensions of the handle frame can be varied.

In another preferred embodiment of the assembly of the invention, provision is made for an opening to be disposed in the bottom surface of the grip enhancer such that a magazine can be inserted into the handle frame through said opening, the base of the magazine also forming a bottom closure for the grip enhancer. Preferably, the opening is provided in the lower region of the panels and the connecting member and is self-contained.

An eyelet device is preferably in the form of an eyelet secured to the grip enhancer. In order to increase stability, two eyelet devices are provided which are disposed in parallel relationship.

The device of the invention is described below with reference to a preferred embodiment illustrated in the figures of the drawings, in which.

Figure 1:
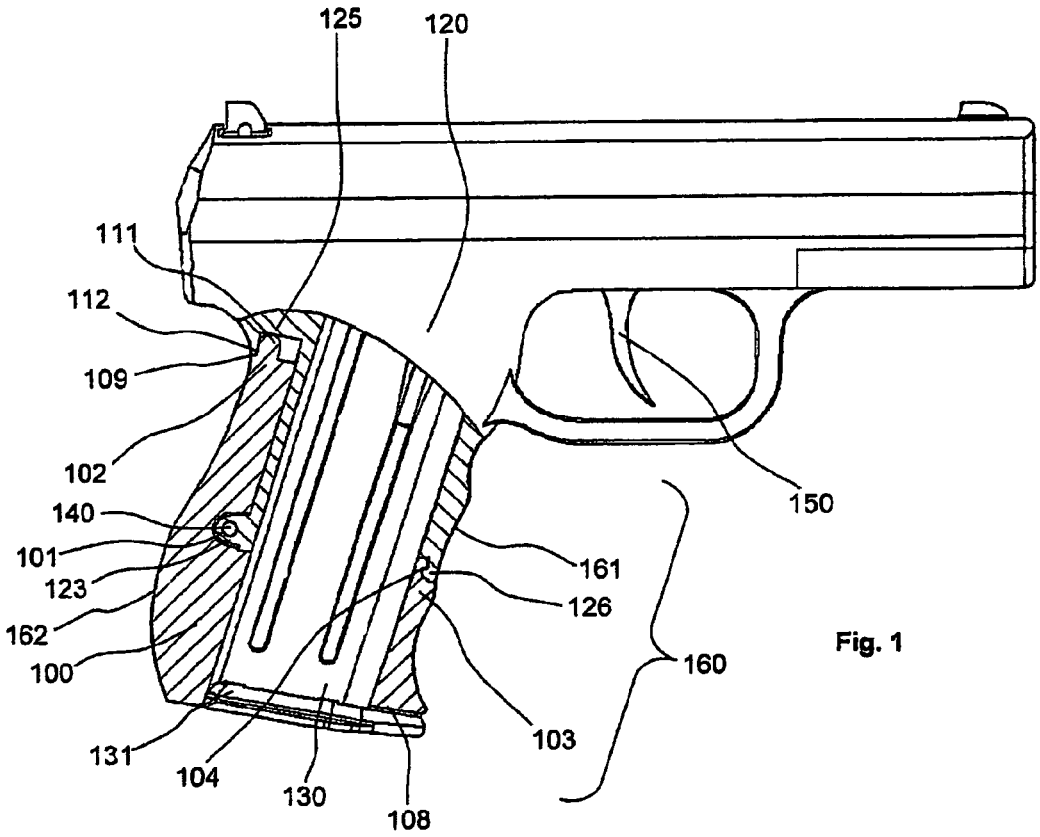
FIG. 1 shows an embodiment of the device of the invention comprising a large grip enhancer, as a side view from the right with a longitudinal cut-away section.
Figure 2:
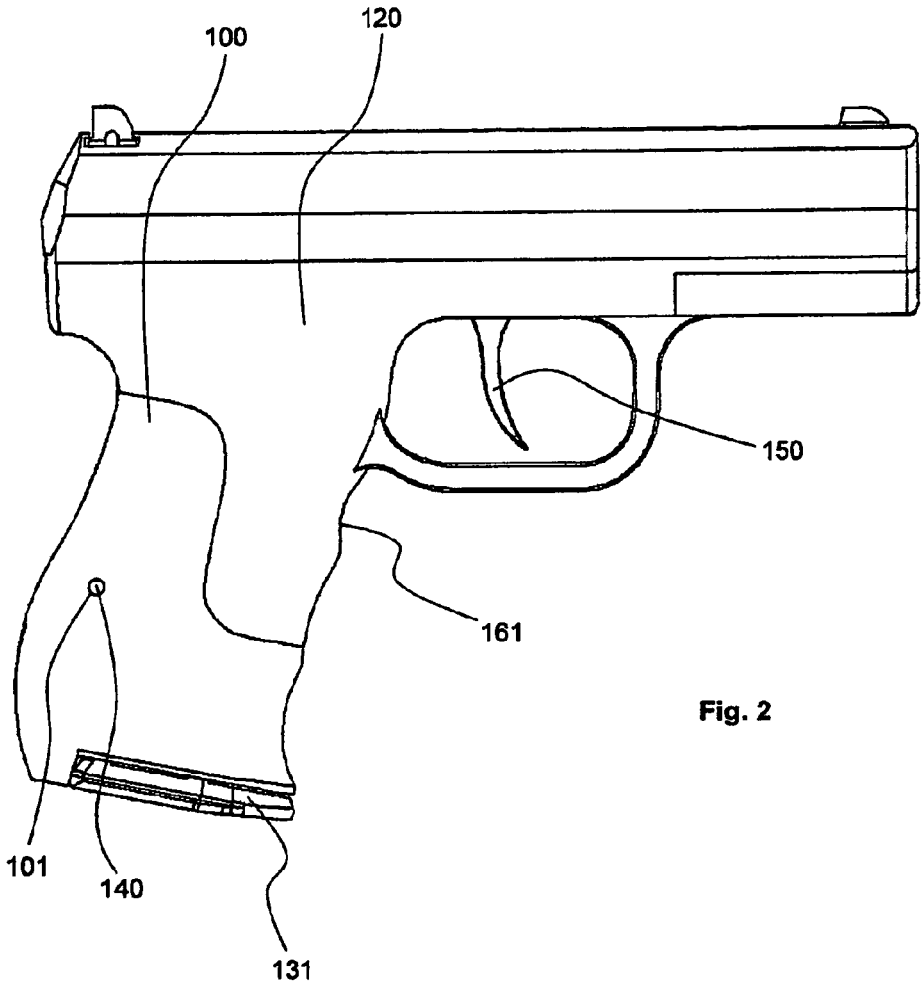
FIG. 2 shows the embodiment of the assembly of the invention having a large grip enhancer as in FIG. 1 as viewed from the right.
Figure 3:
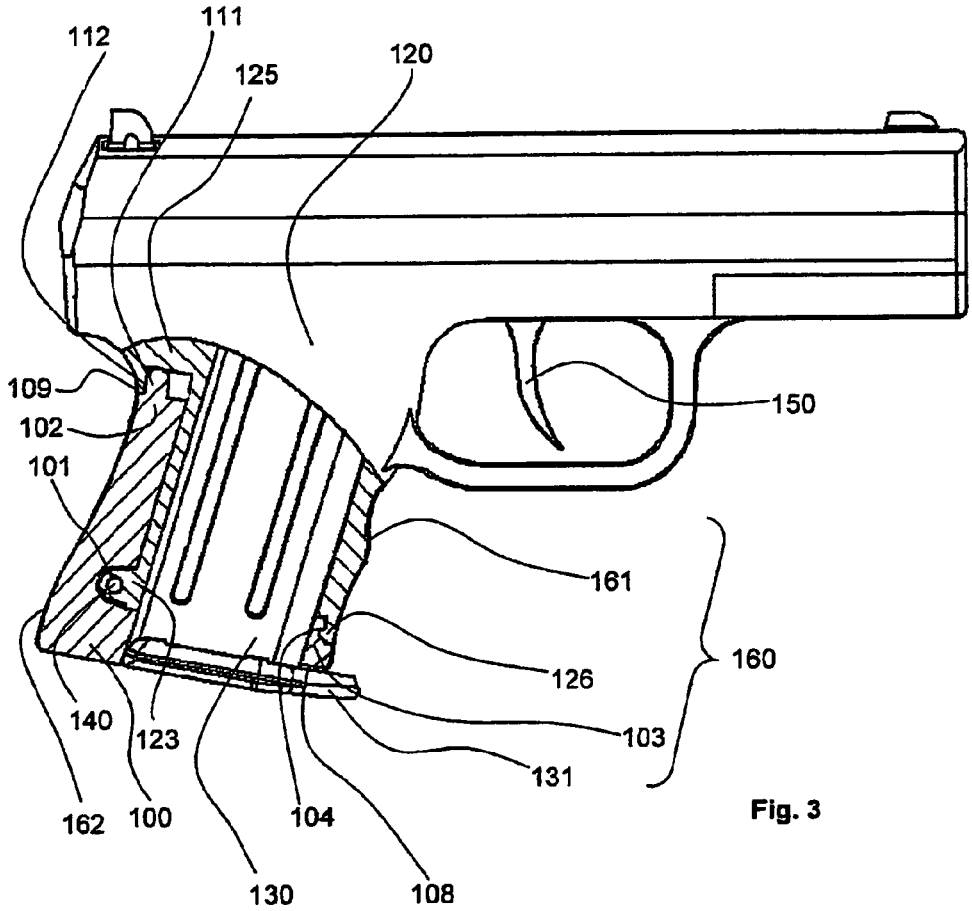
FIG. 3 shows the embodiment of the assembly of the invention, as in FIG. 1, having a small grip enhancer, as a side view from the right with a longitudinal cut away section.
Figure 4:
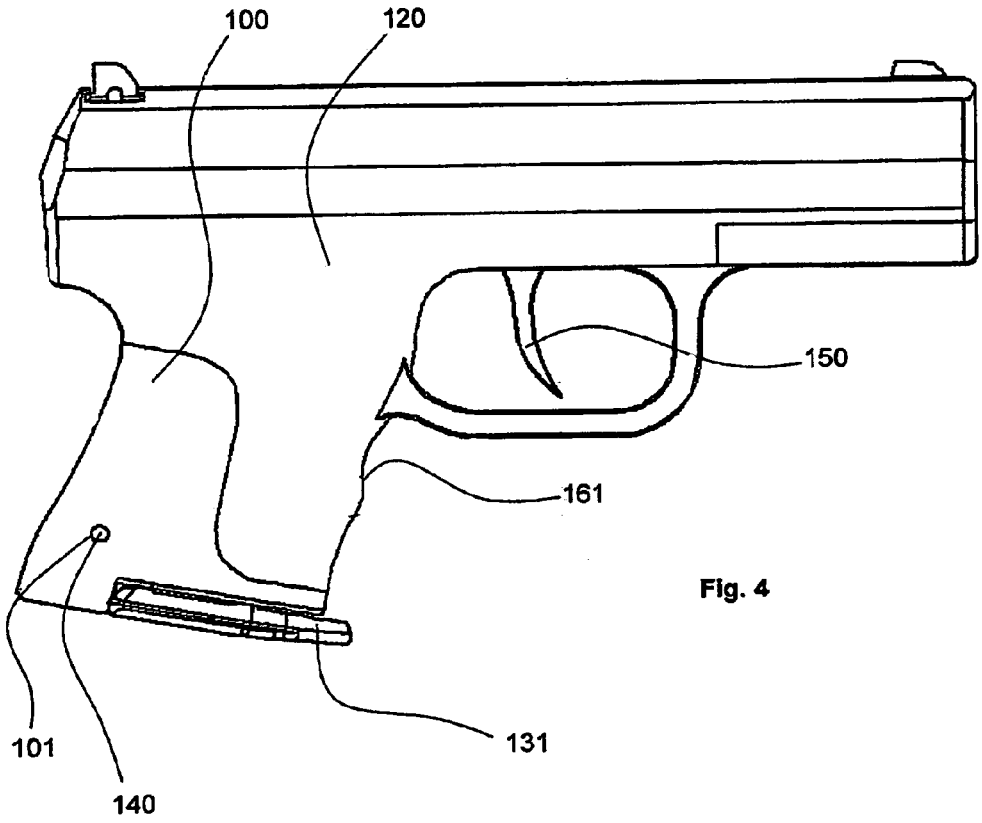
FIG. 4 shows the embodiment of the assembly of the invention shown in FIG. 3, as viewed from the right.
Figure 5:
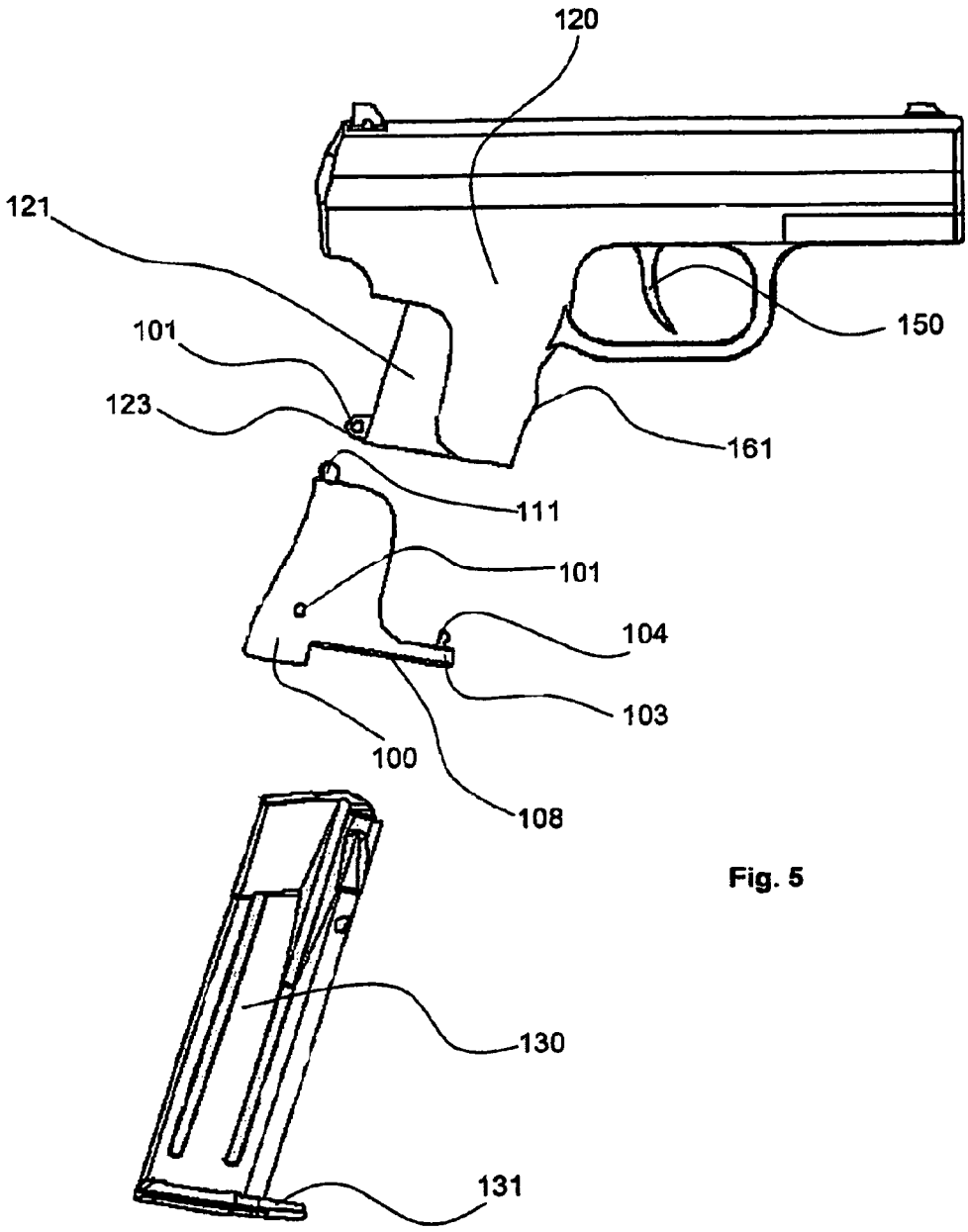
FIG. 5 is an exploded view of the assembly of the invention illustrated in FIGS. 1 to 4 as viewed from the right.
Figure 6:
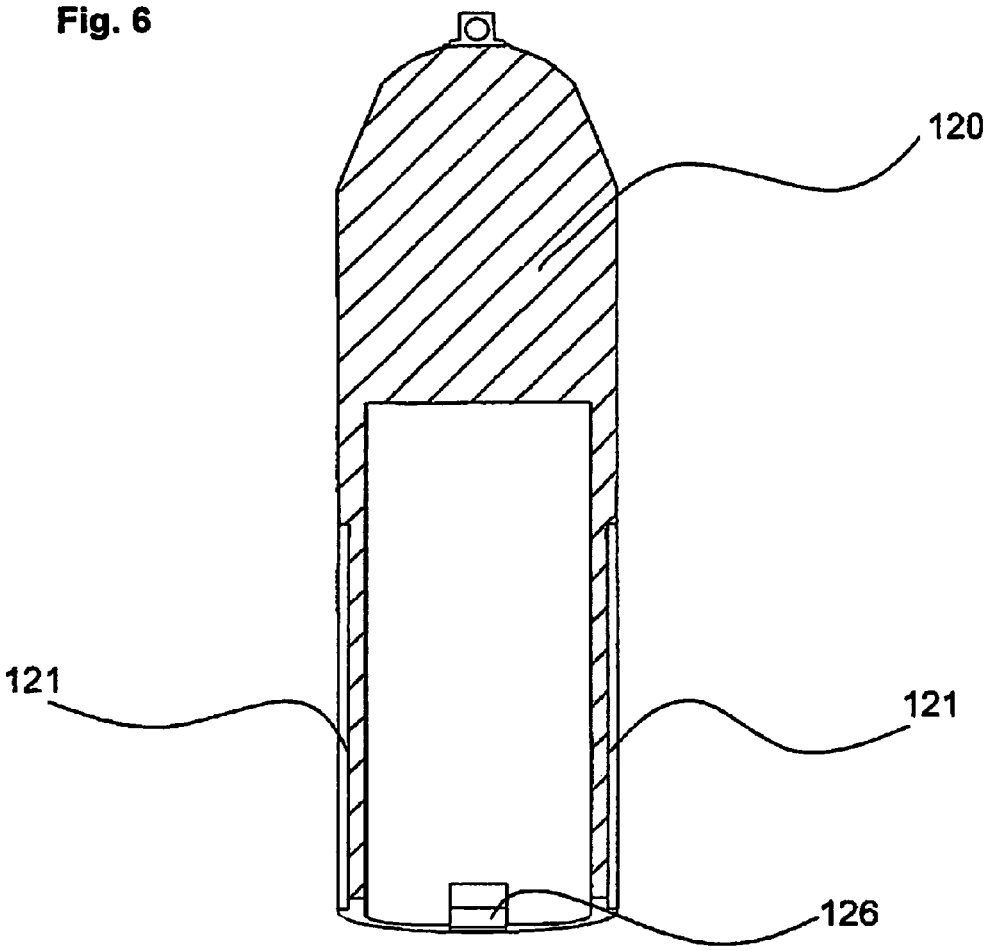
FIG. 6 is a cross section of the handle frame of an embodiment of the assembly of the invention, as viewed from the rear.
Figure 7:
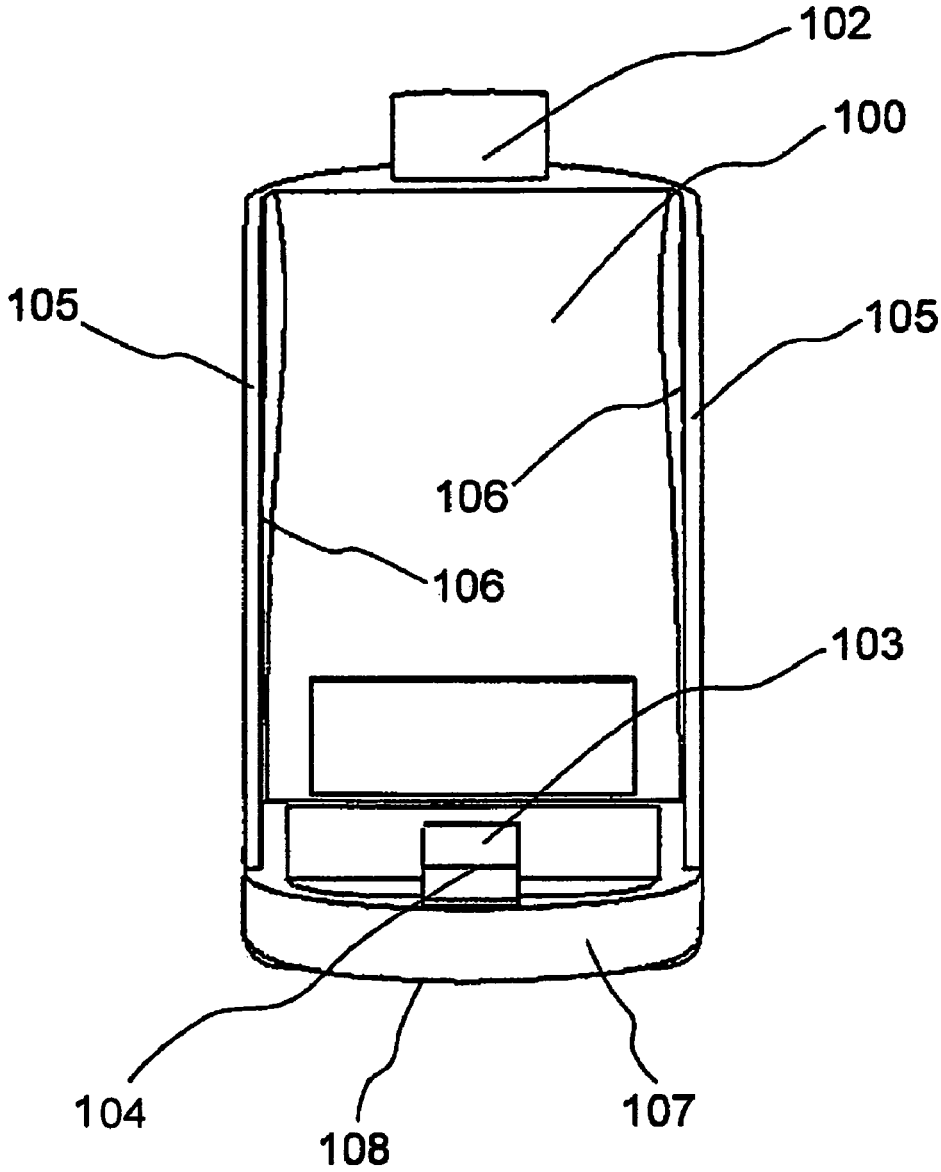
FIG. 7 is a front view of a grip enhancer according to one embodiment of the invention.

The device of the invention shown in FIGS. 1 to 7 is an exchangeable grip enhancer 100 for a handle frame 120 of a handgun comprising a trigger 150 and a handle 160, which handle 160 has a front region 161 which is close to the handle, and a rear region 162 which is more remote from the handle, and a magazine 130 comprising a magazine base 131 can be pushed into the handle 160. The grip enhancer 100 is constructed such that the rear and front regions of the handle frame 120 each have at least one adapter element 102 at the rear and at least one adapter element 103 at the front, which adapter elements can be fitted to the grip enhancer 100 to make it possible to releasably secure the same to the handle frame 120. To this end, two parallel eyelet devices 123 are provided in the rear region of the handle frame 120, which, when the grip enhancer 100 is placed on the handle frame 120, engage positively in a bore 101 in the grip enhancer 100 into which a securing pin 140 can be releasably inserted so as to releasably connect the grip enhancer 100 to the handle frame 120. An eyelet device 123 is in the form of an eyelet fixed to the handle frame 120.

The rear element 102 of the grip enhancer 100 is designed as a lip 111 which can be placed under the rear adapter element 125 of the handle frame 120, which rear adapter element 125 is in the form of a ridge 112 and an appropriate edge 109 of the grip enhancer 100 forms a fulcrum, about which the grip enhancer can be rotated.

The front adapter piece 103 of the grip enhancer 100 is in the form of a resilient snap-in element having a protrusion 104 which can be snapped into the corresponding recess in the front adapter element 126 of the handle frame 120.

The grip enhancer 100 has two side panels 105, the inner faces 106 of which can be pushed over the corresponding outer faces 121 of the handle frame 120, the two panels 105 being interconnected by a front connecting member 107. The inner faces of the panels 106 and the outer faces 121 of the handle frame 120 are approximately planar, the panels 105 for different grip enhancers 100 being designed in various lengths. Furthermore, the panels 105 for the various grip enhancers 100 are constructed in various thicknesses and widths, so that the overall external dimensions of a handle frame 120 can be varied.

The bottom surface 108 of the grip enhancer 100 has an opening, through which a magazine 130 can be inserted into the handle frame 120, the base of the magazine 131 forming a closure for the base of the grip enhancer 100. The opening is provided in a lower region of the panels 105 and the connecting member 107 and is self-contained.

The securing pin 140 can be inserted positively into the bore 101.

The exemplary embodiment of the invention described above merely serves to provide better understanding of the teaching of the invention defined in the claims. The teaching of the invention is not, as such, limited to the exemplary embodiment.

The invention claimed is:

1. An exchangeable enhancer assembly comprising:

a handle frame of a handgun, said handle frame comprising:

a trigger, a handle having a front region facing the trigger, a rear region facing away from the trigger, and a bottom surface extending between the front region and the rear region, at least one first adapter element in the rear region, at least one second adapter element in the front region comprising a recess, and at least one eyelet device in the rear region;

a grip enhancer having:

a rear adapter piece;

a front adapter piece cooperating with the at least one second adapter element of said handle frame when said grip enhancer is attached to said handle frame, said front adapter piece comprising a resilient snap-in element having a protrusion corresponding to the recess, said protrusion being snapped into said recess when said grip enhancer is attached to said handle frame; and a bore positively engaged by the at least one eyelet device of said handle frame when said grip enhancer is attached to said handle frame; and a securing pin releasably inserted into the bore of said grip enhancer, when said grip enhancer is attached to said handle frame, in order to releasably connect said grip enhancer to said handle frame;

wherein a magazine including a magazine base can be inserted into the handle of said handle frame; and wherein said front adapter piece of said grip enhancer covers said front region of said handle frame when said grip enhancer is attached to said handle frame.

2. The exchangeable enhancer assembly as defined in claim 1, wherein said grip enhancer has a first side panel having a first inner face and has a second side panel having a second inner face;

wherein the handle of said handle frame has a first outer face and a second outer face;

wherein the first inner face of the first side panel of said grip enhancer is pushed over the first outer face of the handle when said grip enhancer is attached to said handle frame; and wherein the second inner face of the second side panel of said grip enhancer is pushed over the second outer face of the handle when said grip enhancer is attached to said handle frame.

3. The exchangeable enhancer assembly as defined in claim 2, wherein said grip enhancer has a front connecting member; and wherein the first side panel and the second side panel of said grip enhancer are interconnected by the front connecting member.

4. The exchangeable enhancer assembly as defined in claim 2, wherein the first and second inner faces of the first and second side panels, respectively, of said grip enhancer and the first and second outer faces of the handle of said handle frame are approximately planar.

5. The exchangeable enhancer assembly as defined in claim 2, wherein said panels are of different lengths in different grip enhancers.

6. The exchangeable enhancer assembly as defined in claim 2, wherein said panels are of different lengths and widths in different grip enhancers such that overall dimensions of said handle frame can be varied.

7. The exchangeable enhancer assembly as defined in claim 1, wherein the bottom surface of said grip enhancer has an opening; and wherein a magazine can be inserted into said handle frame through the opening of the bottom surface of said grip enhancer when said grip enhancer is attached to said handle frame, a base of said magazine forming a closure for a base of said grip enhancer when the magazine is inserted into said handle frame.

8. The exchangeable enhancer assembly as defined in claim 7, wherein said grip enhancer has a first side panel having a first inner face and has a second side panel having a second inner face;

wherein the handle of said handle frame has a first outer face and a second outer face;

wherein the first inner face of the first side panel of said grip enhancer is pushed over the first outer face of the handle of said handle frame when said grip enhancer is attached to said handle frame;

wherein the second inner face of the second side panel of said grip enhancer is pushed over the second outer face of the handle of said handle frame when said grip enhancer is attached to said handle frame;

wherein said grip enhancer has a front interconnecting member;

wherein the first side panel of said grip enhancer and the second side panel of said grip enhancer are interconnected by the front connecting member; and wherein said opening of the bottom surface of said grip enhancer is disposed near a lower region of the first and second side panels and the front connecting member.

9. The exchangeable enhancer assembly as defined in claim 1, wherein the at least one eyelet device is fixed to the handle of said handle frame.

10. The exchangeable enhancer assembly as defined in claim 1, wherein the at least one first adapter element comprises a ridge, and the rear adapter piece comprises a lip cooperating with the ridge when said grip enhancer is attached to said handle frame, the lip being placed under the ridge to attach said grip enhancer to said handle frame, wherein the ridge overlaps the lip such that a first distance between the lip and the front region of the handle along an axis extending parallel to the bottom surface of the handle is smaller than a second distance between the ridge and the front region of the handle along the axis extending parallel to the bottom surface of the handle when said grip enhancer is attached to said handle frame, an appropriate edge of said grip enhancer forming a fulcrum, said grip enhancer being rotatable about the fulcrum.

* * * * *